United States Patent [19]

Berwald et al.

[11] Patent Number: 4,807,777

[45] Date of Patent: Feb. 28, 1989

[54] SAFETY TRANSPORT SYSTEM FOR HAZARDOUS OR VALUABLE CHEMICALS

[75] Inventors: Ernst Berwald, Bergkamen; Winfried Lewe, Kamen, both of Fed. Rep. of Germany

[73] Assignee: Schering AG, Berlin and Bergkamen, Fed. Rep. of Germany

[21] Appl. No.: 128,155

[22] Filed: Dec. 3, 1987

[30] Foreign Application Priority Data

Dec. 23, 1986 [DE] Fed. Rep. of Germany ..... 3644088

[51] Int. Cl.[4] ..... B65D 7/42

[52] U.S. Cl. ..... 220/23.83; 220/1.5; 220/5 A; 220/23.4

[58] Field of Search ..... 220/23.83, 23.4, 1 B, 220/1.5, 5 A, 855, 69, 70.1, 23.4

[56] References Cited

U.S. PATENT DOCUMENTS

| | | | |
|---|---|---|---|
| 2,137,255 | 11/1938 | Tuttle | 220/1.5 |
| 3,135,438 | 6/1964 | Wex et al. | 220/327 X |
| 3,162,331 | 12/1964 | Hutchins et al. | 220/1.5 X |
| 3,711,902 | 1/1973 | Eggert, Jr. | 220/1.5 X |
| 3,971,491 | 7/1976 | Mowatt-Larssen et al. | 220/1.5 X |
| 4,060,174 | 11/1977 | Gerhard | 220/1.5 X |
| 4,469,236 | 9/1984 | Marsault et al. | 220/1.5 |

*Primary Examiner*—Steven M. Pollard

*Attorney, Agent, or Firm*—Curtis, Morris & Safford

[57] ABSTRACT

A safety transport system for hazardous or valuable chemicals, particularly in liquid form, is provided. The chemicals are contained, according to their hazardousness and/or vulnerability during transportation, in tanks of relatively small volume which are provided with a base. A plurality of said tanks form a unit load specifically designed for shipment by highway, rail, air or marine transportation means. The unit load of the safety transport system includes one or more tanks, and a container platform for supporting a plurality of intermediate support elements which secure the tanks to the platform.

24 Claims, 9 Drawing Sheets

SAFETY TRANSPORT SYSTEM FOR HAZARDOUS OR VALUABLE CHEMICALS

BACKGROUND OF THE INVENTION

The present invention relates to a safety transport system for hazardous or valuable chemicals, particularly those chemicals in liquid form. The disclosure of this invention has previously been described in Federal Republic of Germany Patent application Ser. No. P 36 44 088.4, filed Dec. 23, 1986, the disclosure of which is incorporated by reference.

It is known to move hazardous or valuable chemicals such as hydrocarbons, liquefied gases, acids, or other chemicals in liquid form, in large tank vehicles by the usual means of transportation in highway, rail, air or marine traffic.

It is further known to carry such hazardous materials, and especially pressurized substances, for example, liquified gases such as methane, propane, nitrogen, oxygen, etc., in tanks of relatively small volume. Shipping these gases in many individual tanks of relatively small volume is often utilized in the case of manufactured gases, where numerous pressure tanks on skids form a unit load. When such unit loads are carried on regular flat-bed trucks, traffic accidents are likely to occur thereby causing incalculable harm to the environment as well as human life.

It is possible that even greater endangerment of the environment and human life may occur when a tank is damaged through technical shortcomings or human failure. Frequently, in such situations, the flammable and/or toxic hazardous liquid is spilled and ignites or explodes. Accidents of this type are known to have occurred increasingly throughout the world over the last few decades, causing vast human suffering as well as destruction to the environment.

OBJECTS OF THE INVENTION

A general object of the present invention is to provide a safety transport system for transporting hazardous or valuable chemicals.

Another object of the present invention is to provide a safety transport system for hazardous or valuable materials, such as toxic or high-purity substances, especially in liquid form, which not only meets existing shipping regulations for highway, rail, air and marine transportation, but also enhances the safety of the system so that major accidents and the hazards which they pose can be reasonably prevented.

A further object of the present invention is to provide for economical and practical handling of the chemicals, which at the same time also contributes greatly to a reduction of the safety hazards associated with transporting these chemicals.

A still further object of the present invention is to maximize the technical safety provisions incorporated in the various components of the transport system and thus provide an integrated package which offers maximum safety in every phase of the transportation process, including the filling and emptying operations for the tanks, assembling a cargo, and unloading the tanks. Thus, this system significantly reduces the likelihood of a hazardous material accident occurring during transportation while at the same time aiding in the handling of the hazardous materials.

SUMMARY OF THE INVENTION

In accordance with these objects, a safety transport system for hazardous or valuable chemicals, particularly in liquid form, is provided wherein the chemicals are contained, according to their hazardousness and/or vulnerability during transportation, in tanks of relatively small volume. A plurality of these tanks are supported on a container platform by one or more intermediate support elements and form a unit load which is specifically designed for shipment by highway, rail, air or marine transportation means. With the design of this unit load, a transport system is provided which assures economical handling of the hazardous materials, minimizes the risks associated with transporting these tanks, and offers extraordinary flexibility in the loading and unloading of one or more tanks of the unit load.

In order to permit economical handling during loading and unloading operation, two tanks may be associated with each intermediate support element. A forklift truck may then economically handle the tanks. This situation typically arises where a tank may have a relatively small volume, for example, a capacity of 50 liters. Preferably, an even number of tanks are associated with each intermediate support element as this configuration enables symmetry of the intermediate support elements.

In order to further enhance the safety of the system, a tank and an associated intermediate support element may also be equipped with mating coupling and/or connecting elements. This is extremely advantageous in that every tank can be individually fastened firmly and securely to an intermediate support element. Moreover, with these coupling elements, it is possible to couple or uncouple, (i.e., load or unload), individual tanks without jeopardizing the safety of the rest of the tanks secured by the safety transport system. In this manner, a flexibility of the transport system hitherto regarded as unobtainable is achieved.

Similarly, an intermediate support element and an associated container platform may be equipped with mating coupling and/or connecting elements. Along with providing an extremely high degree of safety to the system, this coupling of the intermediate support elements to the container platform maximizes the flexibility of the transport system in that the intermediate support elements are united with the container platform offering maximum resistance to external influences. As a result thereof, it is also possible to remove or add individual intermediate support elements without detracting from the safety during transportation of the other intermediate support elements of the transport system. Furthermore, the tank base and the tank may also be equipped with coupling and/or connecting elements permitting them to be attached to or detached from each other.

In order to allow very simple and economical handling of the tanks by means of forklift trucks, for example, the tank base may be provided with fork openings. These forklift openings are interconnected through spacing elements with preferably four stay bolts. With this configuration, the tank can be bolted to four straps provided with receiving bores and welded in appropriate positions to the bottom of the tank to form a resting surface.

These features not only result in enhancing the safety of the individual tanks during transportation but also allows the base structure, detached from the tank, to be galvanized separately from the tank to impart highly effective yet relatively low-cost corrosion protection to the base structure. The tank itself can be provided with a lining appropriate to the specific properties of the liquid with which it is to be filled, for example, an acid-resistant lining, or the tank can be fabricated from a special material such as high-purity aluminum, titanium, a nickel-base alloy or the like.

The intermediate support element may also be provided with means for the positioning and releasable fastening of at least two tanks or tank bases. This results in a substantial cost savings in comparison to individually mounting each tank. Preferably, the intermediate support element has substantially the same dimensions of a pool pallet, these dimensions corresponding to an integer part of the container loading surface. With this design, optimum use is made of the overall capacity of the container loading surface. In addition, the intermediate support elements, which are closely adjacent to one another on their mounts, provide maximum mutual support against external forces, such as those external forces resulting from an accident.

The means for the positioning of tanks on the intermediate support element, and of intermediate support elements on the container loading surface, result in greater ease of handling of the system. In this connection, in the handling of individual tanks or of individual loads in the loading or unloading of a transport system with forklift trucks, hazardous situations can arise. In order to avoid these hazardous situations, the pool pallet may include a frame with four fork openings intersecting in pairs. A pallet can thus be picked up with a forklift truck from any side and moved to a predetermined location. The pool pallet may further include guide plates which function as coupling or positioning elements, and as releasable fastening elements. In addition, the pool pallets may further include pivotally secured eyebolts with ring nuts which engage rectangular slots in the spacing elements located between the fork openings of the tank base.

This results in an uncomplicated and safe fastening system whose functioning can be visually monitored at any time during transportation since the pivotally secured eyebolts are captive and always in the correct position. With this fastening system, fastening can also be effected with a minimum amount of effort.

Preferably, slanted receiving angle brackets are also disposed as spacing elements on the tank base between the fork openings to provide ease in handling. These angle brackets are provided with rectangular slots to be engaged by the eyebolts.

The moving of individual pallets is greatly aided by providing the pallets with a crane loop in each of their four corners. In the loading and unloading of the transport system, a pallet can then be picked up by a shop crane, for example, with a jib in the form of a cross prepared for that purpose. With this design of the crane loops, the pallets may be moved within the plant safely by a shop crane.

Moreover, each pallet is provided with two base plates having a rectangular slot to be engaged by pivoting-bolt locks attached to the container platform. Each pallet can then be individually set onto the container platform and secured to it without impairing the mounting of the other pallets on the container platform. This arrangement offers the further advantage that the pivoting-bolt locks provide the system with a maximum of mounting security with a minimum amount of effort.

The container platform may further include a rectangular frame formed of lengthwise and cross members and mounting rails extending at right angles to the longitudinal direction. Two pivoting-bolt locks associated with each pallet are positioned between the mounting rails and are secured to the container frame. In furthering the ease of handling the pallets, these two pivoting-bolt locks are pivotally secured to a common actuating rod on the outside of the container platform. This actuating rod is provided with a grip adapted to be lead-sealed.

In addition, this system enhances the safety of each individual tank during handling, filling and emptying operations. Each tank includes a massive, substantially flat cover adapted to be bolted. The tanks also include a sealing ring, which is interposed to a flange disposed on the top of the tank. With this design, the cover can be removed to expose the entire cross-sectional area of the tank, which economically provides the tank with a lining appropriate not only for the liquid which it is contains but also with respect to cleaning and inspection of the tanks.

This cover may also be provided with two crane loops to facilitate the handling of the cover. The cover is also provided with a splash skirt extending beyond the flange, which protects against splashing of the liquid and also protects the sealing surface from mechanical damage, which for example could occur when the cover is set down after having been removed.

Valves may also be mounted by means of stud bolts on the tank cover. Each of the necessary lower flanges of the valves are centered by a ring welded to the cover. In order to enhance the safety of the system, the valve connections may be closed by blank covers with a splash skirt and a grip. These valves are likewise incorporated in the system for safety, for greater ease of handling, and for ready replacement following a special or routine inspection. Thus, these valve features facilitate maintenance and make the tanks easy to service. The welded-on ring also provides splash protection and protects the stud bolts particularly from shearing stresses due to horizontal forces being applied against the valves.

Finally, a protective cap enclosing the space above the cover and adapted to be fastened by bolts is provided for the protection of the valves. The cap is also fitted with a splash-protector ring.

Other objects and advantages of the invention will become apparent from the following detailed description and from the appended drawings in which like numbers have been used to describe like parts of the several views.

BRIEF DESCRIPTION OF THE DRAWINGS

The following detailed description, given by way of example, but not intended to limit the present invention solely to the specific embodiments described, may best be understood in conjunction with the accompanying drawings in which.

DETAILED DESCRIPTION OF THE PREFERRED EMBODIMENTS

Figure 1B:
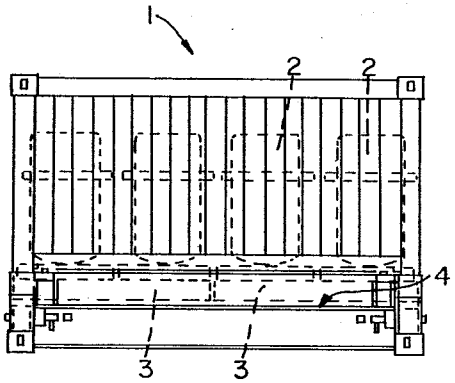
FIGS. 1*a* to 1*c* show a safety transport system in accordance with a preferred embodiment of the present invention in a side elevational, a front elevational and a top plan view, respectively.
Figure 1A:
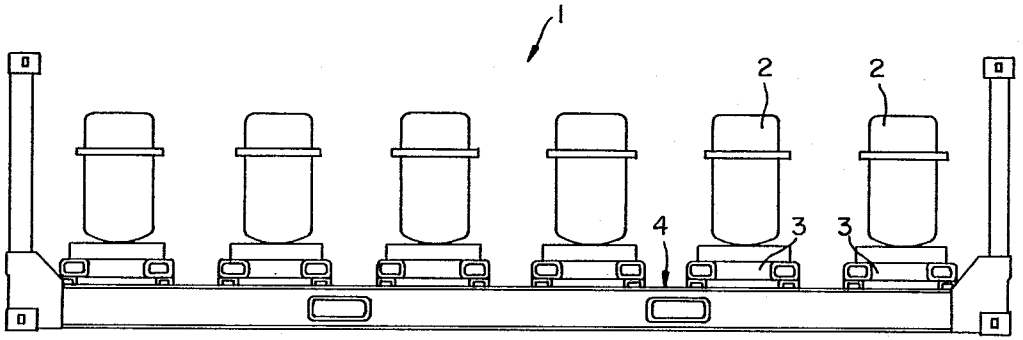
Figure 1C:
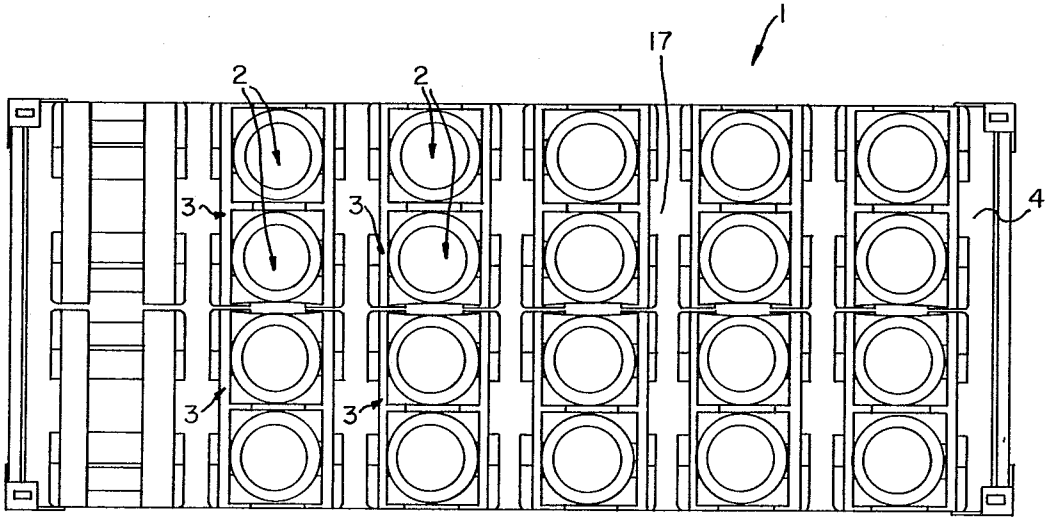

Referring now to FIGS. 1*a* to 1*c*, the present invention relates to a safety transport system for hazardous or valuable chemicals including a unit load 1 with a plurality of tanks 2, with one or more tanks being supported by several intermediate support elements 3 on a container platform 4. In the preferred embodiment, there are twelve intermediate support elements 3.

As is apparent from FIGS. 1*a* to 1*c*, one tank, two tanks or another even number of tanks may be associated with each intermediate support element 3. Since an intermediate support element 3 is preferably a rectangular structure with an aspect ratio of 2 to 3, there may be two small tanks mounted on the intermediate support element in the transverse direction and three in the longitudinal direction, for example, making a total of six tanks. With a still smaller tank size, $3\times4=12$ tanks, for example, may be mounted on an intermediate support element. Of course, different arrangements may also be chosen as desired by the user.

In accordance with an object of the present invention, each tank 2 is secured to a corresponding intermediate support element 3 by first coupling elements 5 and/or first connecting elements 6. Moreover, each intermediate support element 3 is secured to its corresponding container platform 4 by second coupling elements 7 and/or second connecting elements 8.

Figure 3:
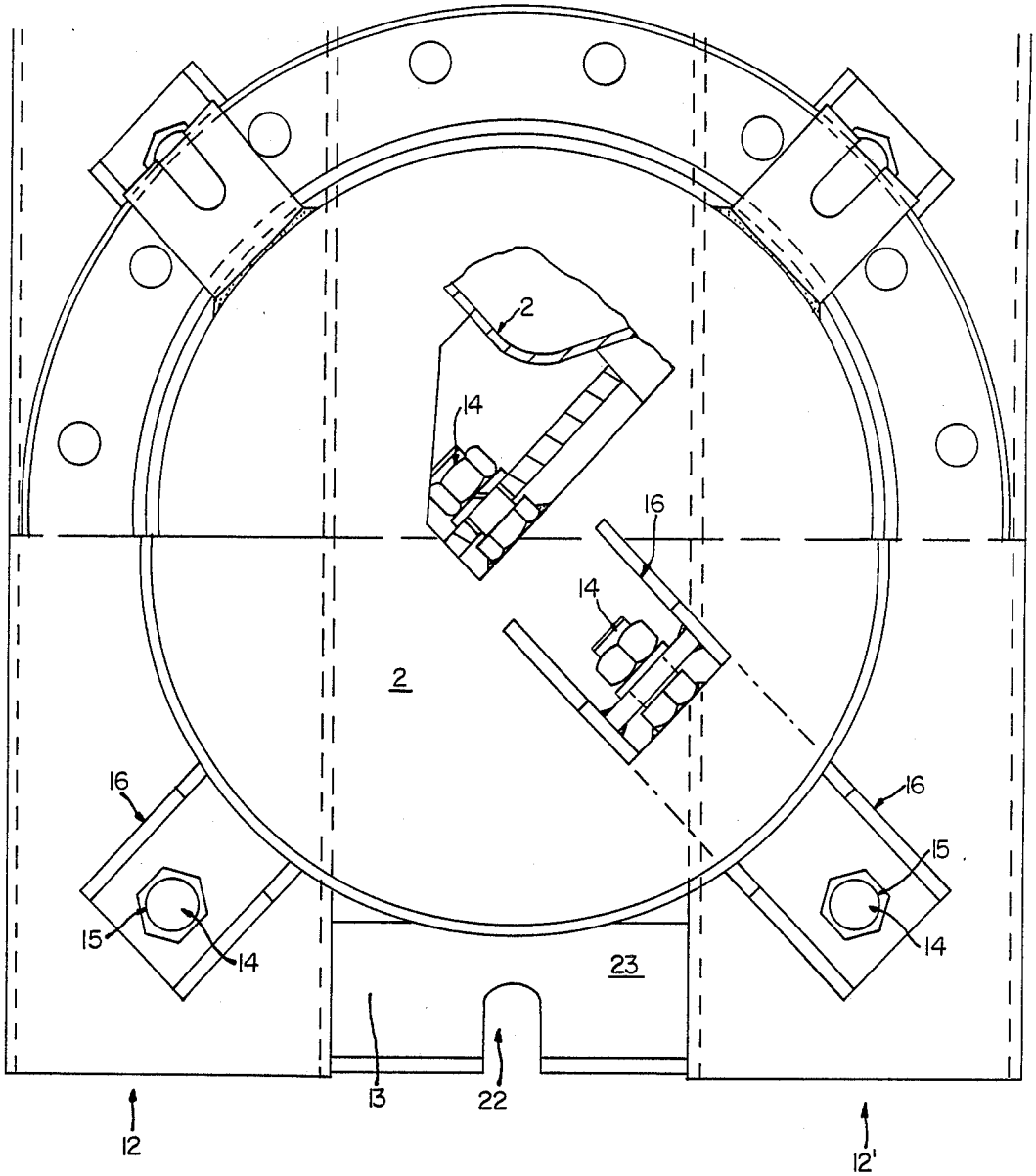
FIG. 3 above the center line is a top plan view of the tank, and below the center line is a half-sectional view through the tank taken along the horizontal sectional plane III—III in FIG. 2, with a top plan view of the base adapted to be bolted to the tank.

The tank base 9 and the tank 2 are also adapted to be attached to and detached from each other by means of third coupling elements 10 and/or third connecting elements 11 as is shown in FIG. 3. As aforedescribed, it is extremely advantageous to provide a separate tank and tank base as it enhances economical fabrication of the tank 2 and base 9. The latter may be a very simple and practical steel structure including fork openings 12 while the tank 2 may be constructed of another material, such as high-purity aluminum, titanium, or a highly acid-resistant nickel-base alloy. The tank may also be provided with a lining of various materials, including, but not limited to, rubber or plastic, depending on the liquid it is to contain.

As is shown in FIG. 3, the tank 2 includes welded-on straps 16 as coupling elements 10, and the tank base 9 includes welded-on stay bolts 14 as connecting elements 11.

The tank base 9 includes fork openings 12 which are interconnected by spacing elements 13. These fork openings permit individual tanks to be moved by a fork-lift truck and thus provide for ease in handling and in-plant haulage. The straps 16 are advantageously attached to the tank 2 in such a way that they form a resting surface in the horizontal plane. As a result of the placement of the straps, the tank 2 is thus able to firmly stand upright with the tank base 9 removed.

With this configuration, a tank 2 that is bolted to a tank base 9 may be mounted firmly and securely on an intermediate support element 3 for shipment. In order to secure the tank structure on the intermediate support element, the intermediate support element 3 is provided with means 5 and 6 for the positioning and releasable fastening of two tanks 2 or tank bases 9, for example. However, as aforementioned, individual tanks can also be firmly secured to an intermediate support element by means of appropriate connecting elements.

The dimensions of the intermediate support element 3 are the same as a pool pallet, these dimensions approximately corresponding to an integer part of the container loading surface 17. The preferred size ratios allow the container surface 17 to accommodate two pallets in a row at right angles to its longitudinal direction, and in its longitudinal direction six parallel rows of pallets. This spatial arrangement permits a very simple and straightforward handling of the pallets during loading and unloading operations.

Figure 4B:
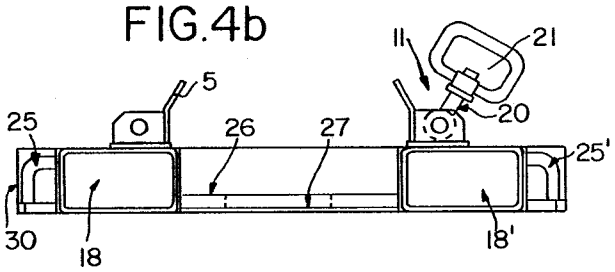
FIGS. 4*a* to 4*c* are side elevational, front elevational and top plan views, respectively, of a preferred embodiment of the pool pallet of the present invention.
Figure 4A:
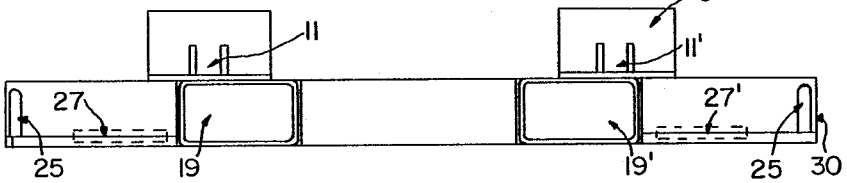
Figure 4C:
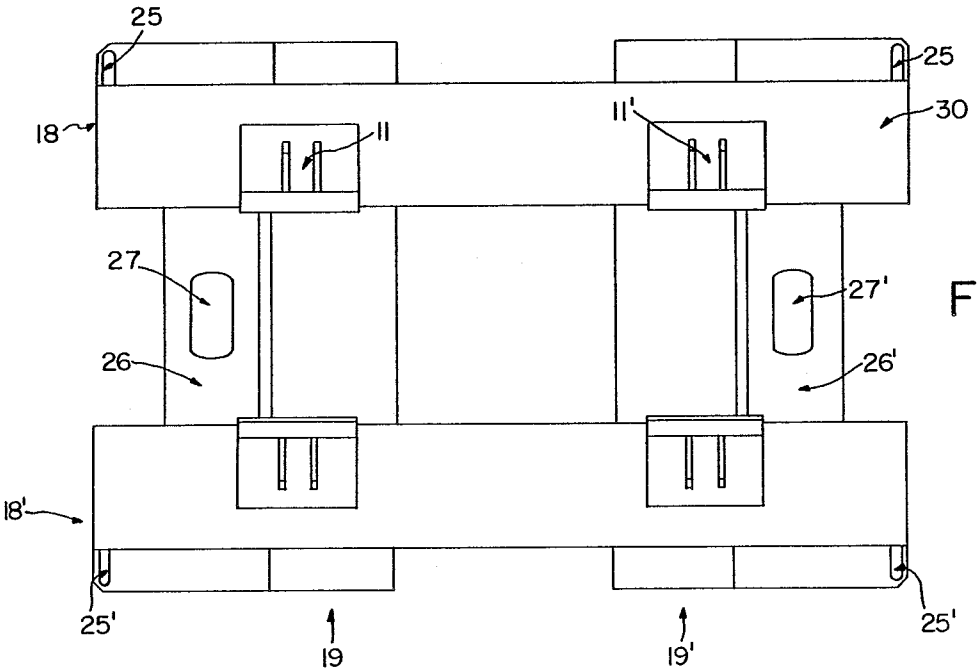

The pool pallet 30 may also include a frame with four fork openings 18, 18′ and 19, 19′ intersecting in pairs as is illustrated in FIGS. 4*a*–4*c*. The pool pallet 30 further includes guide plates 5 functioning as coupling or positioning elements, and/or as shown in FIG. 4, releasable pivotally secured eyebolts 20 with ring nuts 21 which engage rectangular slots 22 in the spacing elements 13 located between the fork openings 12 of the tank base 9. Furthermore, the spacing elements 13 between the fork openings 12 of the tank base 9 include slanted receiving angle brackets 23 having rectangular slots 22 which are secured by bolts 20.

As is shown in FIGS. 4*a*–4*c* and 5, the pool pallet is provided with a crane loop 25 in each of its four corners. It can then be carried safely and conveniently within the plant, or in loading and unloading, by a crane using a suitable lifting attachment.

For the attachment of the pool pallet 30 to the container platform 4, two base plates 26 of the pallet 30 are each provided with an elongated hole 27 to be engaged by pivoting-bolt locks 28 that are secured to the container platform 4. These pivoting-bolt locks offer the advantage that they can be readily operated yet provide a quick-release closure that has significant holding power.

Figure 8:
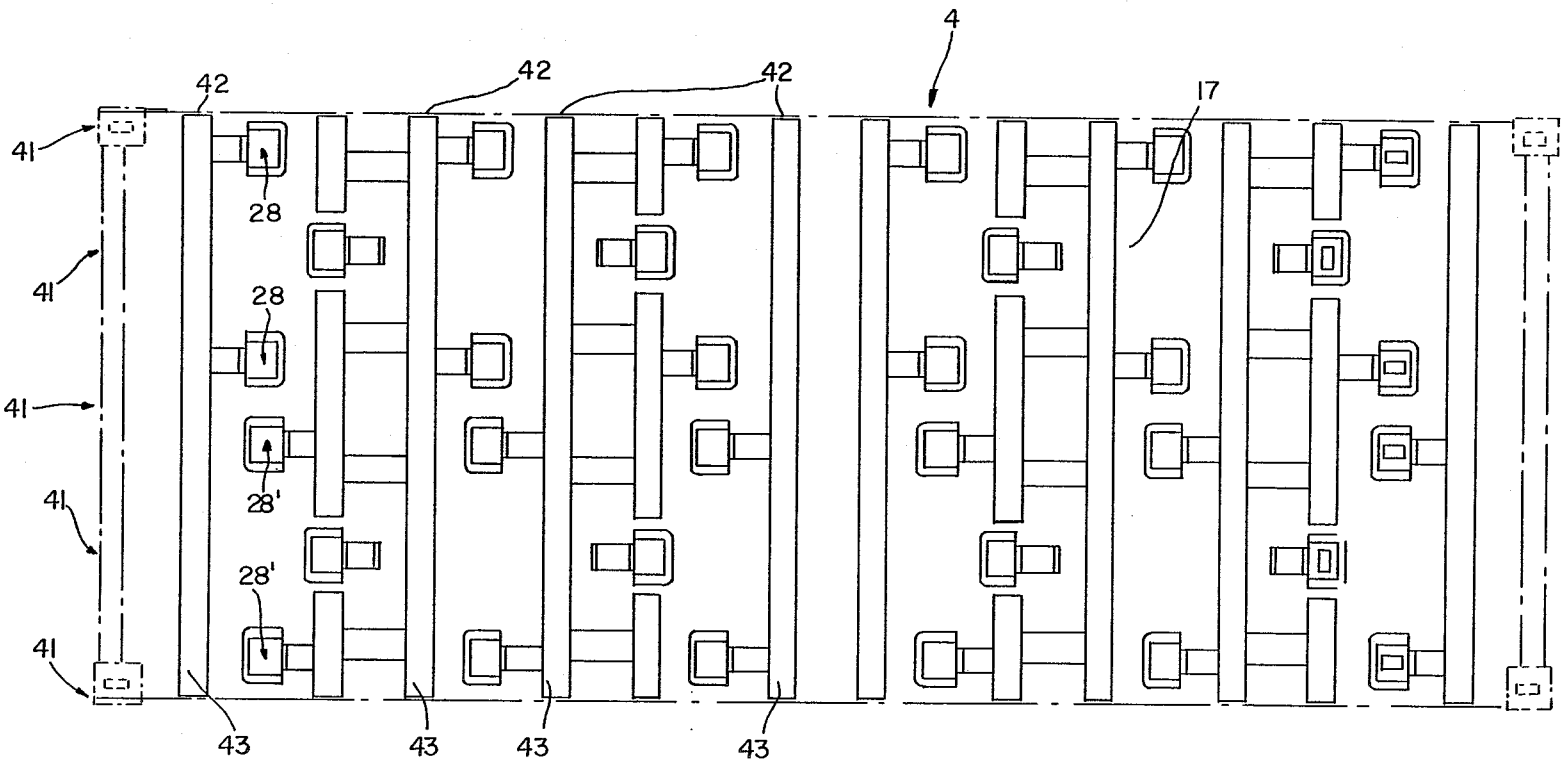
FIG. 8 is a top plan view of an empty container platform of a preferred embodiment of the present invention.

As is shown in FIG. 8, the container platform may further include a rectangular frame formed of lengthwise members 41 and cross members 42, with mounting rails 43 extending substantially normal to the longitudinal direction for the mounting and securing of the pool pallets 30. Between these rails, two pivoting-bolt locks 28 associated with each pallet 30 are attached to the container frame.

Figure 2A:
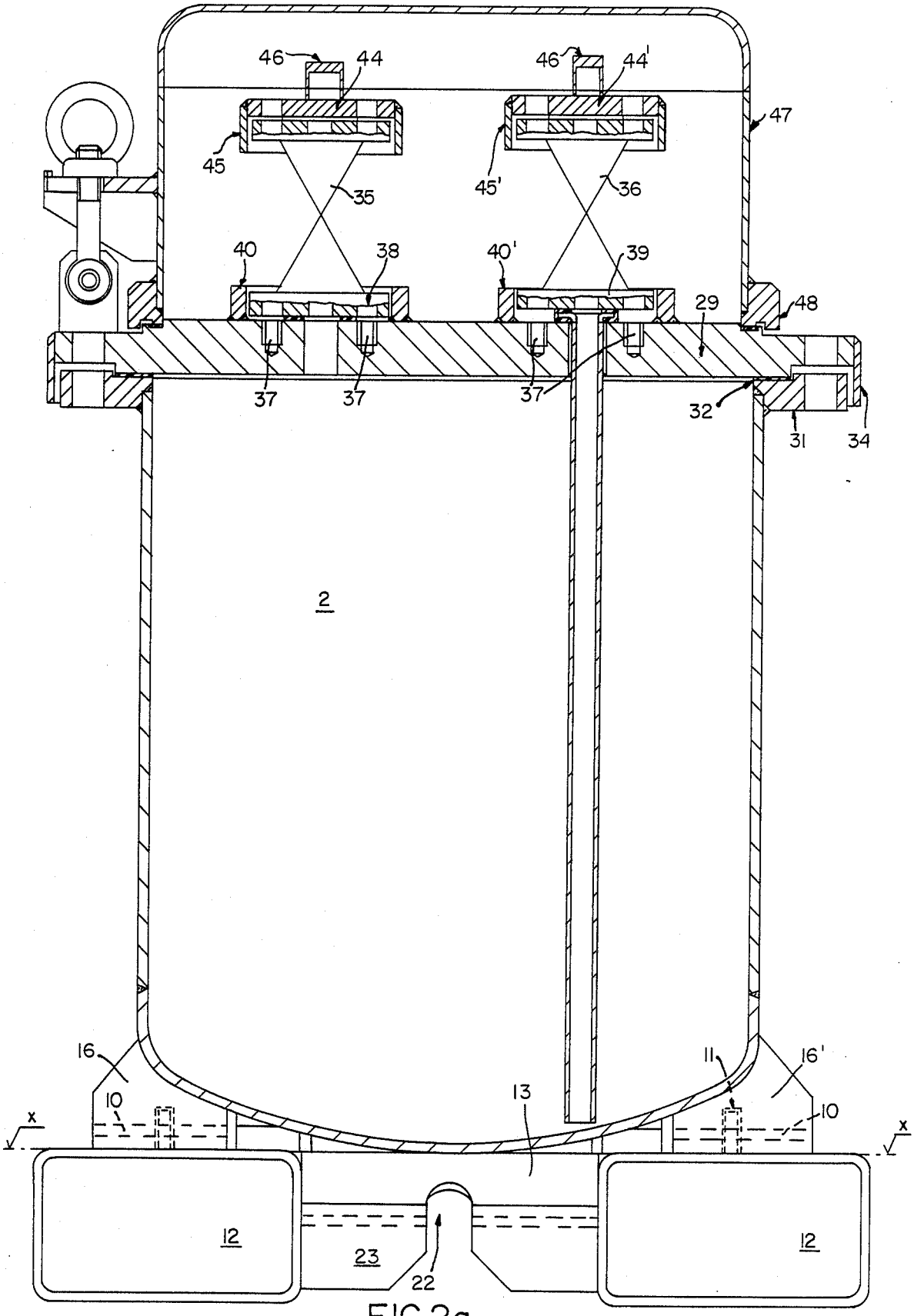
FIGS. 2*a* and 2*b* are a longitudinal sectional view and a partial front elevational view, respectively, of a preferred embodiment of the tank incorporated in the system of FIGS. 1*a* to 1*c*.
Figure 2B:
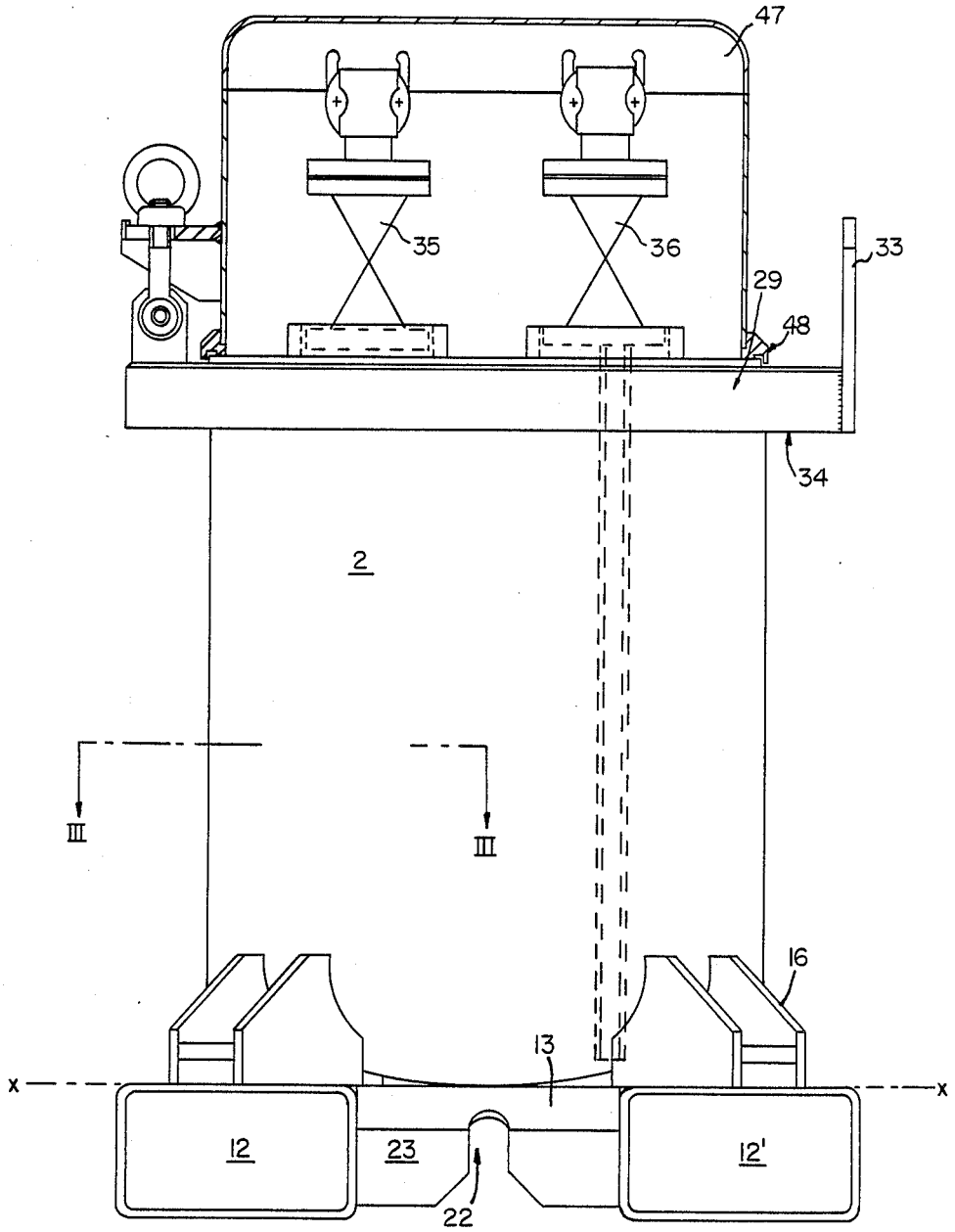

Consistent with the requirement that the transport system be designed for maximum safety, special safety provisions are incorporated also in the tanks 2. For example, every tank has a massive, substantially flat cover 29 designed to be bolted onto a flange 31 with a sealing ring 32 between them (see FIG. 2*a*). Moreover, the cover 29 is provided with two crane loops 33 (FIG. 2*b*). When it has to be moved, the cover can thus be readily and safely carried by a shop crane. Such a cover is desirable in that when it is removed, the full cross-sectional area of the tank is exposed. This permits economical tank fabrication, especially when the tank is to be lined with rubber or plastic. It further facilitates periodic inspection and monitoring of the tank interior. If desired, the cover 29 may also be manufactured from a material other than the material of the body of the tank 2.

In addition, the cover 29 is provided with a splash skirt 34 which extends beyond the flange 31. This splash skirt affords splash protection while at the same time protects the sealing ring 32 or its sealing surface from mechanical damage when the cover 29 is removed and replaced.

Moreover, valves 35 and 36 are mounted on the tank cover 29 by means of stud bolts 37, each of the lower valve flanges 38 and 39 being centered through a ring 40 welded onto the cover 29. This provides splash protection, and the stud bolts 37 are at the same time protected from shearing stresses occurring, for example, due to a sideways blow against the valves.

In order to maximize safety considerations, blank covers 44 are provided with a splash skirt 45 and a grip 46 as closures for the valve connections.

Finally, a protective cap 47 which encloses the space above the cover 29 is provided for the protection of the valves 35 and 36. The protective cup 47 is mounted by means of bolts and includes a splash-protection ring 48 as well.

Figure 5:
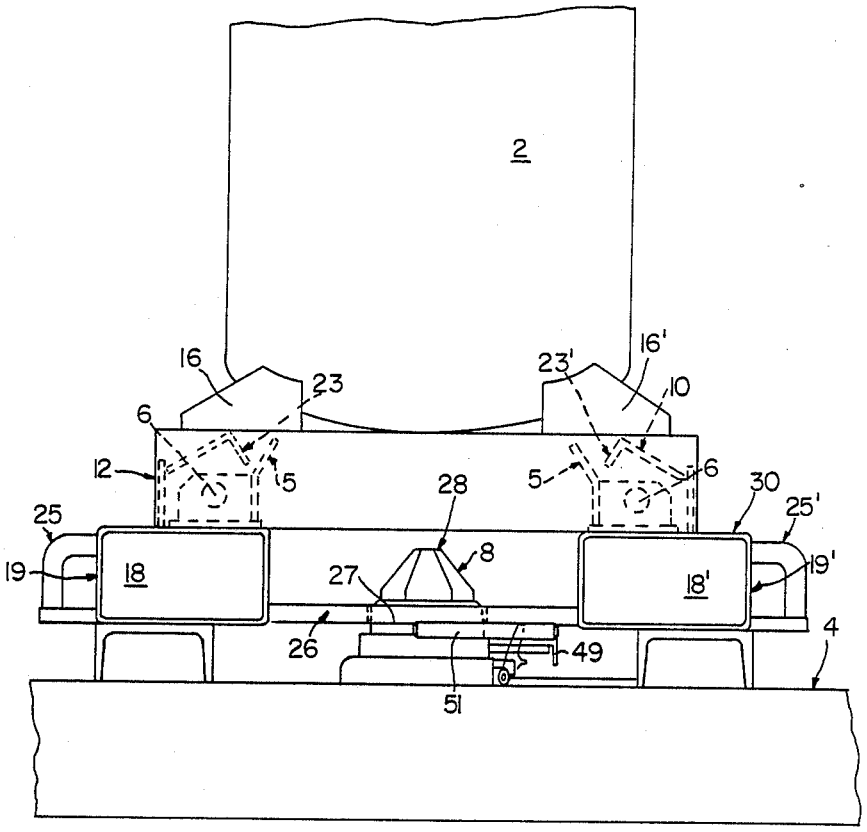
FIG. 5 is a side elevational view of a portion of a container platform of a preferred embodiment of the present invention with a pallet supporting a tank base being secured to the platform by a lead-sealed pivoting-bolt lock.
Figure 6:
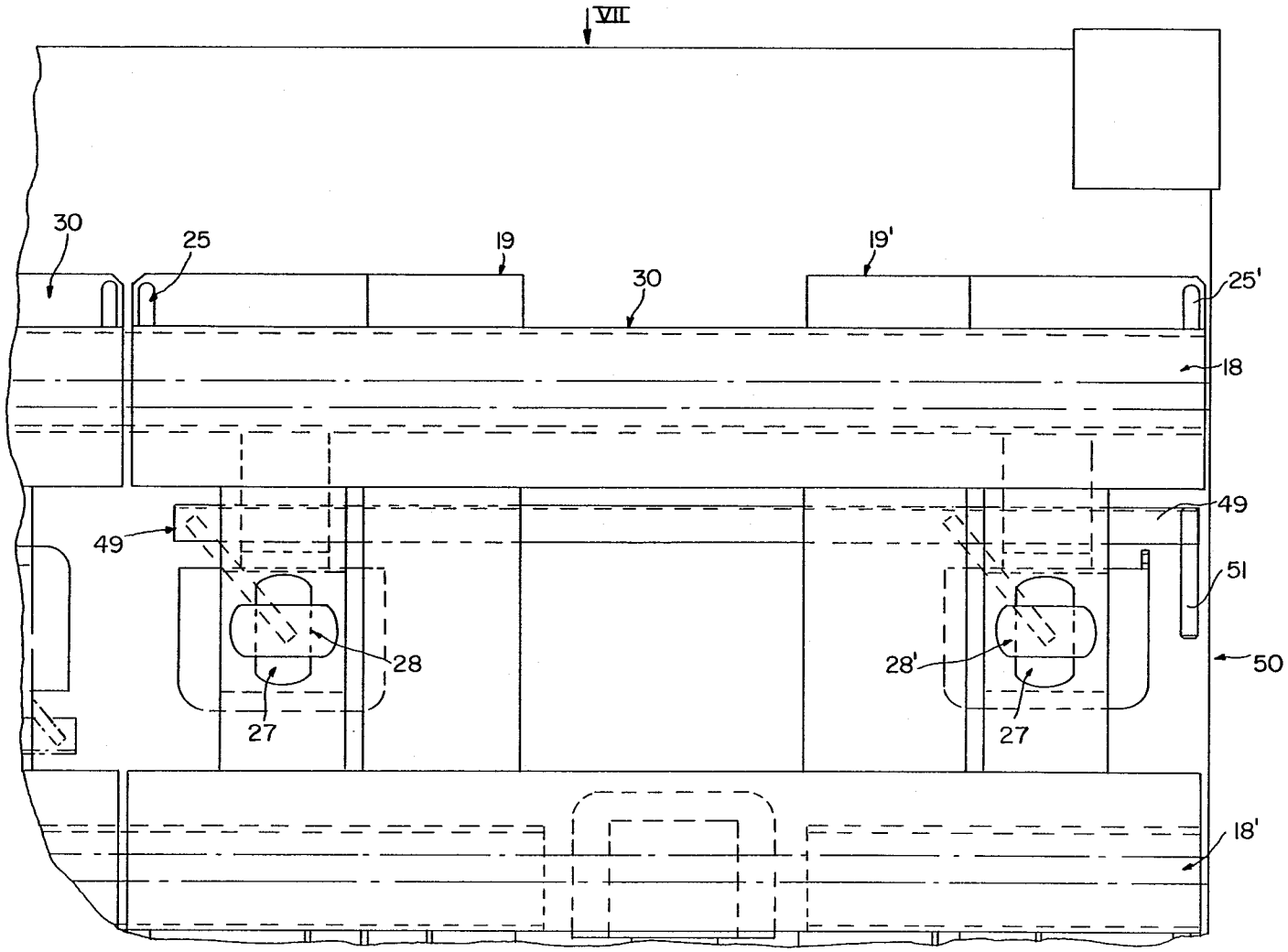
FIG. 6 is a top plan view of a portion of the container platform having a pallet being secured by two pivoting-bolt locks in the locked position which are lead-sealed.
Figure 7:
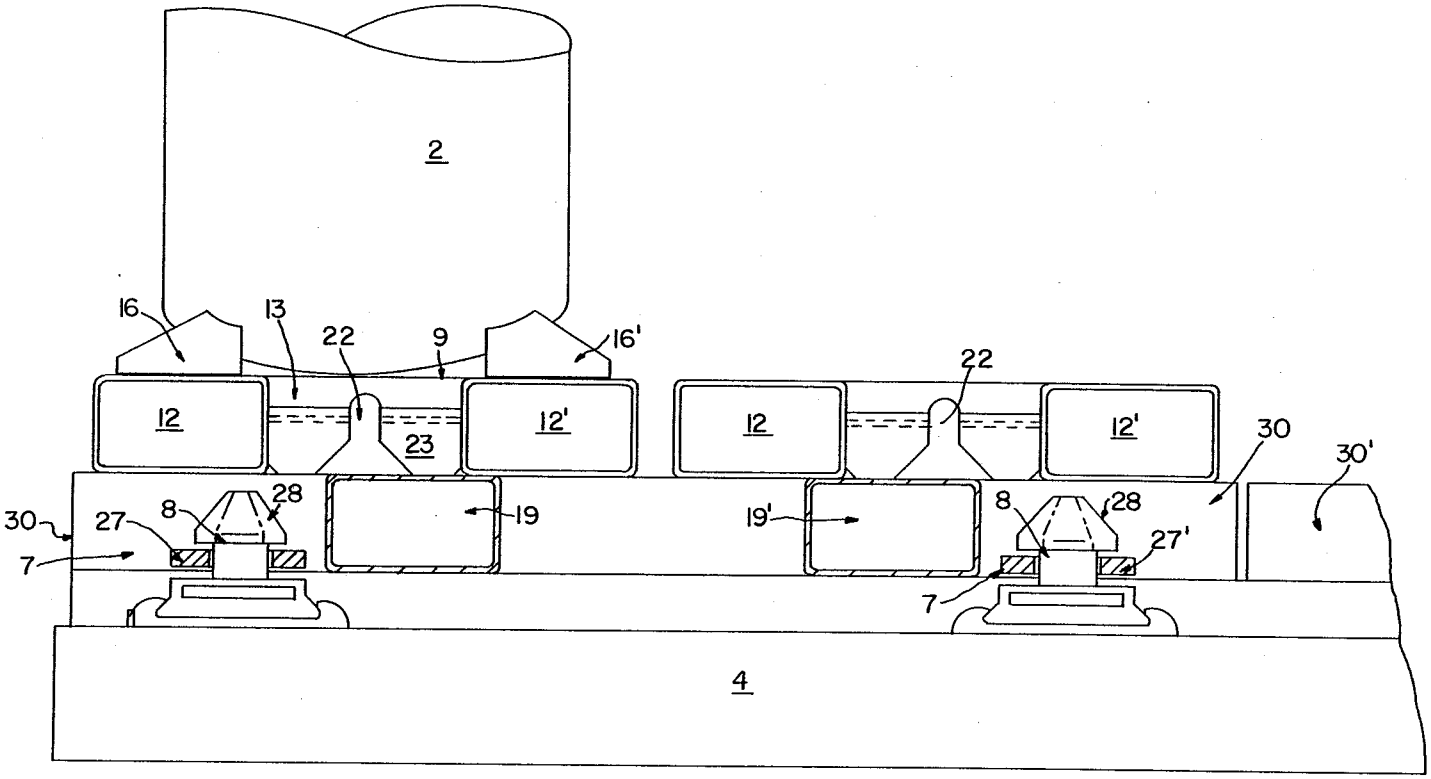
FIG. 7 shows a portion of the container of FIG. 6 in a side-elevational view taken from the direction indicated by arrow VII in FIG. 6.

As is illustrated in FIGS. 5 to 7, two pivoting-bolt locks 28 are pivotally secured to a common actuating rod 49. The latter is provided on the outside 50 of the container platform with a grip 51 capable of being lead-sealed. Thus, the securing of a pool pallet 30 to the container platform 4 is readily accomplished.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention, which is defined by the following claims.

We claim:

1. A safety transport system for shipment of chemicals in a modular unit load comprising a plurality of variably-sized tanks containing the chemicals and supported in a generally vertical condition, each said tank being provided with a tank base; a container platform; intermediate support elements resting on said container platform and each carrying at least one tank; detachable coupling elements being arranged between each tank and its associated tank base, said tank base and its associated intermediate support element, and said associated intermediate support element and said container platform; said plurality of tanks, tank bases, intermediate support element and container platform forming the unit load; and each said unit load having means engagable with a lifting apparatus.

2. The safety transport system as set forth in claim 1 wherein at least two tanks are associated with each intermediate support element.

3. The safety transport system as set forth in claim 1 wherein an even number of tanks are associated with each intermediate support element.

4. The safety transport system as set forth in claim 1 wherein the tank and an intermediate support element associated therewith are provided with first mating coupling elements and first connecting elements.

5. The safety transport system as set forth in claim 1 wherein the intermediate support element and the container platform associated therewith are provided with second mating coupling elements and second connecting elements.

6. The safety transport system as set forth in claim 1 wherein the tank base and the tank are provided with third coupling elements and third connecting elements whereby the tank base and tank can be attached to or detached from each other.

7. The safety transport system as set forth in claim 1 wherein the tank base includes fork openings.

8. The safety transport system as set forth in claim 1 wherein the tank base includes fork openings substantially interconnected by spacing elements and provided with preferably four stay bolts welded along predetermined positions to the bottom of the tank securing four straps, said tank base being provided with receiving bores which form a resting surface.

9. The safety transport system as set forth in claim 1 wherein each intermediate support element is provided with means for the positioning and releasable fastening of two or more tanks.

10. The safety transport system as set forth in claim 1 wherein the intermediate support element has approximately the same dimensions as a pool pallet, the dimensions corresponding to an integer part of the container loading surface.

11. The safety transport system as set forth in claim 10 wherein the pool pallet includes a frame with four fork openings intersecting in pairs.

12. The safety transport system as set forth in claim 10 wherein the pool pallet includes guide plates having releasable fastening elements including pivotally secured eye-bolts with ring nuts which are capable of engaging rectangular slots in the spacing elements located between the fork openings of the container base.

13. The safety transport system as set forth in claim 12 and further including slanted receiving angle brackets which are disposed on the tank base between the fork openings and are provided with rectangular slots to be engaged by the eyebolts.

14. The safety transport system as set forth in claim 10 wherein the pool pallet is provided in each of its four corners with a crane loop.

15. The safety transport system as set forth in claim 10 wherein at least two base plates of the pallet are provided with an elongated hole to be engaged by pivoting-bolt locks secured to the container platform.

16. The safety transport system as set forth in claim 10 wherein the container platform includes a rectangular frame formed of lengthwise members and cross members and provided with mounting rails extending generally normal to the longitudinal direction for the mounting and securing of the pool pallets and between which two pivoting-bolt locks associated with each pallet are secured to the container frame.

17. The safety transport system as set forth in claim 10 wherein each tank includes a substantially flat cover which is adapted to be bolted to a flange secured to the top of the tank with a sealing ring.

18. The safety transport system as set forth in claim 17 wherein the cover is provided with two crane loops.

19. The safety transport system as set forth in claim 17 wherein the cover is provided with a splash skirt extending beyond the flange.

20. The safety transport system as set forth in claim 17 and further including valves which are secured to the tank cover by means of stud bolts, said valves having inlet and exit openings.

21. The safety transport system as set forth in claim 20 and further including lower valve flanges welded onto the cover and centered by a ring.

22. The safety transport system as set forth in claim 20 wherein said valve openings are adapted to be closed by blank covers provided with a splash skirt and a grip.

23. The safety transport system as set forth in claim 20 and further including a protective cap which is provided for the protection of the valves and encloses the space above the cover, said cap is adapted to be fastened by means of bolts.

24. The safety transport system as set forth in claim 23 wherein the protective cap is fitted with a splash-protector ring.

* * * * *